United States Patent [19]

Barnhart et al.

[11] 4,266,528

[45] May 12, 1981

[54] DUCTED/DUCTLESS RANGE HOOD

[75] Inventors: David A. Barnhart, Madiera; Ronald L. Britt, Middletown; John E. Kroger, Centerville; David A. Walters, Middletown, all of Ohio

[73] Assignee: The Celotex Corporation, Tampa, Fla.

[21] Appl. No.: 969,023

[22] Filed: Dec. 13, 1978

[51] Int. Cl.[3] ..... F24C 15/20

[52] U.S. Cl. ..... 126/299 D; 98/115 R

[58] Field of Search ..... 126/299 D, 299 E, 299 F, 126/389; 98/115 R

[56] References Cited

U.S. PATENT DOCUMENTS

| | | | |
|---|---|---|---|
| 2,633,071 | 3/1953 | Erickson | 126/299 D |
| 2,634,718 | 4/1953 | Williams . | |
| 2,857,836 | 10/1958 | Bernstein | 126/299 D |
| 2,868,108 | 1/1959 | Petersen . | |
| 2,886,124 | 5/1959 | Scharmer . | |
| 3,000,292 | 9/1961 | Wojan . | |
| 3,051,158 | 8/1962 | Kimberley . | |
| 3,111,077 | 11/1963 | Cortright . | |
| 3,328,560 | 6/1967 | Dills . | |
| 3,376,804 | 4/1968 | Marles | 126/299 D |
| 3,422,809 | 1/1969 | Perry . | |
| 3,592,121 | 7/1971 | Lundy . | |
| 3,664,255 | 5/1972 | Kuechler . | |
| 3,690,245 | 9/1972 | Ferlise et al. . | |
| 3,719,137 | 3/1973 | Gould . | |
| 3,895,570 | 7/1975 | Eagleson . | |
| 3,999,471 | 12/1976 | Bishop . | |
| 4,011,802 | 3/1977 | Molitor et al. . | |
| 4,088,123 | 5/1978 | Bowen | 126/299 D |
| 4,114,589 | 9/1978 | Berlik . | |
| 4,120,290 | 10/1978 | Bowen et al. . | |

*Primary Examiner*—Herbert F. Ross

*Attorney, Agent, or Firm*—James W. Grace; Charles W. Vanecek

[57] ABSTRACT

A range hood for an enclosure, which may be either ducted or ductless, comprises a hood having an inner compartment, said inner compartment having an air inlet aperture and first and second air outlet apertures; a blower means disposed within said hood and adapted to draw air from said enclosure through said air inlet aperture into said inner compartment and to discharge the air from said inner compartment through said outlet apertures; a damper member mounted for movement between a first position blocking said first outlet aperture, sand a second position not blocking said first outlet aperture, said damper member being normally biased to said first, blocking position; a first means for selectively locking or unlocking said damper member in said first position; and a second means for selectively opening or closing said second outlet aperture, such that, when said second outlet aperture is open and said damper member is locked in said first position, the air drawn into said inner compartment by said blower means is discharged therefrom through said second outlet aperture and, when said second outlet aperture is closed and said damper member is not locked in said first position, the air drawn into said inner compartment by said blower means moves said damper member to said second position and is discharged out of said first outlet aperture.

22 Claims, 13 Drawing Figures

FIG.5
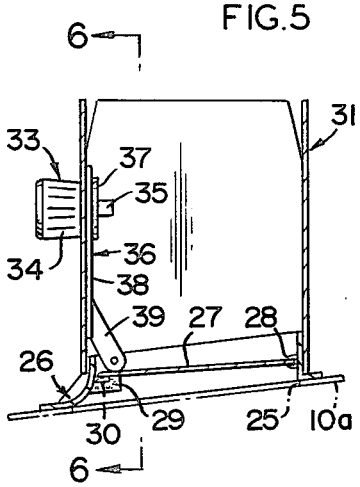
FIG.4
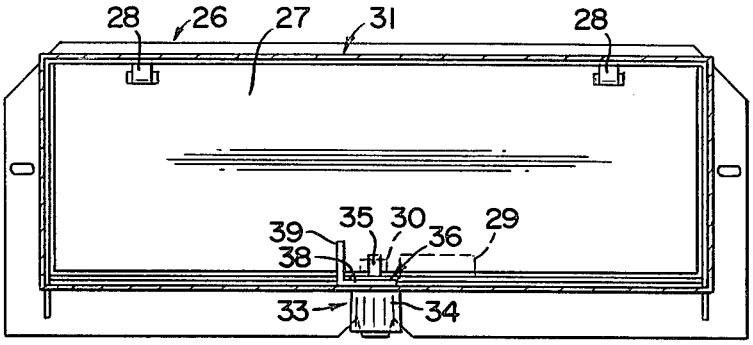
FIG.6
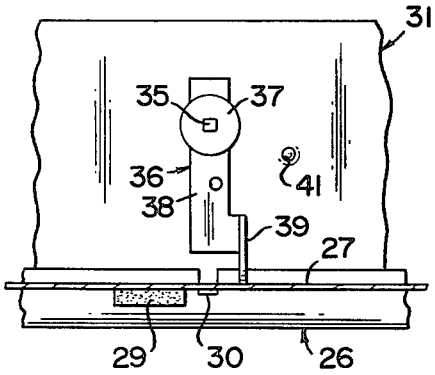
FIG.7
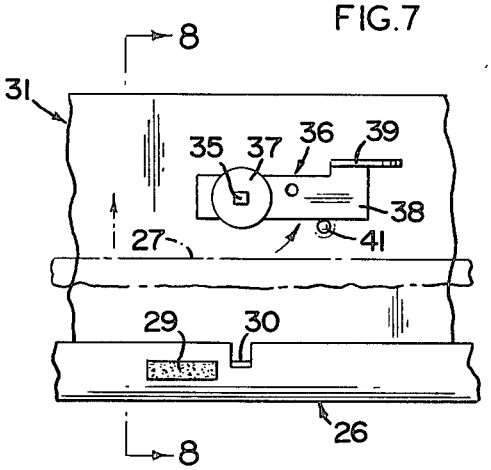
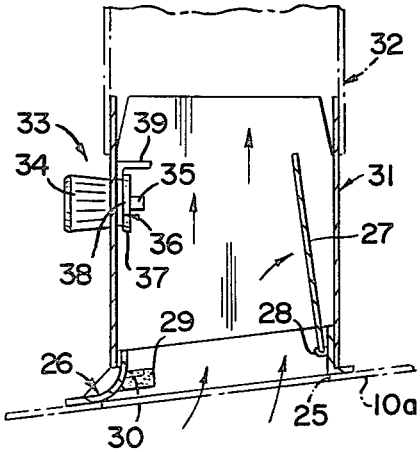
FIG.8
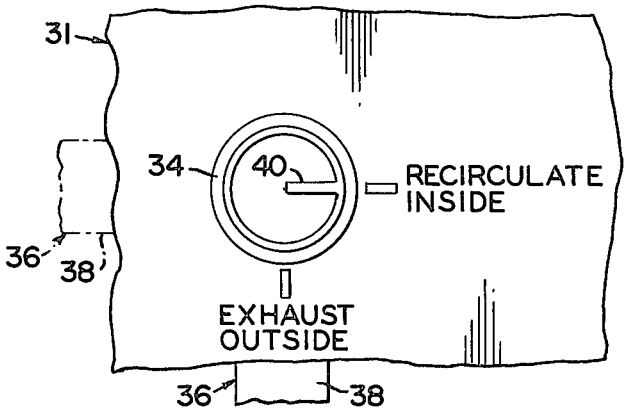
FIG.10
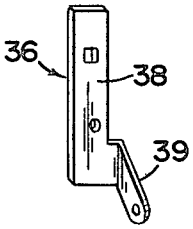
FIG.9

DUCTED/DUCTLESS RANGE HOOD

FIELD OF THE INVENTION

The invention relates to a range hood unit which is provided with means whereby the direction of the air flow in the hood is readily controlled; the hood being easily changeable into either a ducted unit—exhausting air outside the ventilated enclosure—or a ductless unit—recirculating air inside ventilated enclosure. This conversion is accomplished without the necessity for revamping and reinstalling the range hood.

RELATED ART

The term range hood as used in this application means a box-like ventilating shield (open at the bottom), usually fabricated from sheet steel, which is designed to be installed in a horizontal position, spaced above a cooking stove or cooktop, for the purpose of removing the heated air, water vapor or steam, smoke particles, grease particles and volatile fat vapors, as well as the odors that result from many food cooking operations. The range hood can also remove from an enclosure stale air not associated with cooking.

An essential component of any range hood is a fan or blower, powered by an electric motor, which provides an induced draft of air movement to draw the heated air and other volatile products of the cooking operation from the space above the burners into the hood. This removal of the heated air and other volatiles prevents their accumulation in the stove area and thereby results in cooler comfort conditions for the cook. The blower motor is usually controlled by a manually operated off-and-on switch. It can have various control positions, such as one "on" position, a low and high speed "on" position, low, medium, and high "on" positions, or a continuously variable speed control, as, e.g., a solid state type control.

In the past, two basic types of range hoods have been utilized for home kitchens: ducted and ductless. The ducted hood is provided with an outlet orifice on the discharge side of the blower which is connected to a duct that discharges the heated air and other volatile and airborne products that are carried in the air stream to the air outside the kitchen. When the cooking range is in a kitchen location that does not afford convenient access to a wall in which a duct to discharge the heated air outside the building may be installed, the ductless type of range hood can be used. With the ductless hood the heated air from the cooking operation is first thoroughly filtered to remove grease, smoke and fine food particles and to absorb cooking odors, and is then returned to the room through a vent at the top of the hood, overhead and away from the cooking area.

A major disadvantage of the ductless range hood as compared with a ducted hood is that the heated air and steam from food cooking are not removed from the kitchen, and consequently the cooling effect provided by the ducted hood is not obtained. However, this very property of the ductless range hood of delivering heat back to the ventilated enclosure results in a conservation of energy, which can be most advantageous in these times of diminishing and ever more costly energy resources.

It has long been recognized that it would be beneficial to be able to use the heat from cooking ranges for heating the room in which the range is located. And it has further been realized that it would be desirable to provide a range hood which may be either ducted or ductless. One such hood is described in U.S. Pat. No. 3,690,245. To provide for a ducted operation utilizing this hood, a knock-out panel provided in the unit must be manually removed and the duct work must then be attached thereto. This type of unit suffers from the obvious drawback that once it is installed, the user cannot then select a different mode of venting of the heated air without a major alteration of the system. Consequently, the user loses the advantage of selectively directing the heated air where it could be most beneficial. For example, in winter it would be desirable to permit the heated air to circulate back to the area being vented for added warmth. On the other hand, in summer one would want to dispose of the heated air by venting it to the outside to keep the interior as cool as possible.

Various attempts have been made to provide a venting system which can be converted from a ducted to a ductless mode of operation and vice versa with a minimum of effort. Although these attempts have met with a measure of success, the resulting ventilating systems often suffer from disadvantages such as an undue complexity in design and/or equipment, inefficiencies in operation, lack of versatility, etc. In U.S. Pat. No. 2,634,718, for example, there is described a gas oven ventilating system wherein a flap valve is manually adjustable between two positions, so as to vent heated air either inside or outside the enclosure where the gas range is located. The venting arrangement disclosed in this reference is built into the gas range. This means that the user of the range is committed to this particular type of venting system, which would not be the case if the venting means were separate from the range. Also, it is desirable to have a venting system separate from the cooking appliance which can then be better utilized under more exhaust conditions than the one which is specifically tailored to a particular appliance. Another disadvantageous feature of the ventilating unit in U.S. Pat. No. 2,634,718 is that it pulls the heated air being exhausted downward and thus loses the advantage in permitting the heated air to rise in the venting process.

It is also known to use combinations of dampers for directing heated air either back into or out of the kitchen area. Such systems are described, for example, in U.S. Pat. Nos. 2,886,124 and 4,120,290. These venting arrangements generally require a number of working parts which must all cooperatively function to bring about the desired venting effect. The use of single dampers is also disclosed in U.S. Pat. No 4,120,290 but even these venting modes involve the interaction of a number of elements.

An optional discharge venting system with a single damper is again described in U.S. Pat. No. 4,114,589. This system is built into an oven appliance and is limited to interior or exterior venting of the heated air from a food-processing oven or the like cooking appliance. Its range of operation is thus restricted and does not include, for example, the exhaustion of stale air from the room area where it's located.

OBJECTS OF THE INVENTION

It is an object of the present invention to provide an improved ventilation unit having a simple and versatile design which can function as either a ducted or ductless unit.

It is a further object of the present invention to provide a range hood unit having a relatively simple construction which can be easily converted from a ducted to a ductless mode of operation and vice versa without revamping and reinstalling the range hood.

It is yet another object of the present invention to provide a range hood unit which can be readily adapted to either withdraw the heat from a cooking range and thus cool the ventilated enclosure or return the heat back to the enclosure and thereby effect a conservation of the heat energy.

It is still another object of the present invention to provide a simple method for venting air to either the inside or outside of a ventilated enclosure, which can be utilized in various existing ventilation units without this dual capability, after suitable modification thereof.

These and other objects of the invention will become more apparent as the description thereof proceeds.

SUMMARY OF THE INVENTION

The above objects were achieved in the ventilation system of the invention which has means for so controlling the direction of the air flow therethrough that the hood can be readily interconverted between ducted and ductless modes of operation. The range hood is suitably placed over the area to be exhausted so that the heated air and other volatile products of the cooking operation can flow into it. The hood is provided with a blower means which can take in the air and other volatiles from the enclosure being exhausted and blow them to the interior of the hood. Preferably, filtering means are placed between the vented enclosure and the blower means for air purification. The range hood of the invention further has control means for directing the air flow blown by the blower means either back into the enclosure being vented or outside said enclosure, said control means comprising means for confining said air flow to a passage back into said enclosure and for permitting said air flow to force its way out of said enclosure.

The invention, more particularly, resides in a range hood for an enclosure comprising:

(a) a hood including an inner compartment, said compartment having an air inlet aperture and first and second air outlet apertures;

(b) a blower means disposed within said hood and adapted to draw air from said enclosure through said air inlet aperture into said inner compartment and to discharge the air from said inner compartment through said outlet apertures;

(c) a damper member mounted for movement between a first position blocking said first outlet aperture and a second position not blocking said first outlet aperture, said damper member being normally biased to said first, blocking position;

(d) a first means for selectively locking or unlocking said damper member in said first position; and (e) a second means independent of said damper member for selectively opening or closing said second outlet aperture, such that, when said second outlet aperture is open and said damper member is locked in said first position, the air drawn into said inner compartment by said blower means is discharged therefrom through said second outlet aperture and, when said second outlet aperture is closed and said damper member is not locked in said first position, the air drawn into said inner compartment by said blower means moves said damper member to said second position and is discharged out of said first outlet aperture.

DESCRIPTION OF THE DRAWINGS

In the drawings:

FIG. 4 is an enlarged view from above of the adapter assembly and transition section of FIG. 3 in the ductless operation;

FIG. 5 is an enlarged side sectional view of the adapter assembly and transition section of FIG. 3 in the ductless operation;

FIG. 6 is a view of a segment of the adapter assembly and transition section of FIG. 5 as viewed in the direction of arrows 6—6 in the ductless operation;

FIG. 7 is a view of the segment of the adapter assembly and transition section of FIG. 6 in the ducted operation;

FIG. 8 is a side sectional view of the adapter assembly and transition section of FIG. 7 as viewed in the direction of arrows 8—8 in the ducted operation;

FIG. 9 is a perspective view from the rear of the locking cam of FIGS. 4–6 in its vertical position in the ductless operation;

FIG. 10 is an enlarged fragmentary view from the front of the control knob for the locking cam of FIGS. 4–6 in the ductless operation;

DETAILED DESCRIPTION OF THE INVENTION

Figure 1:
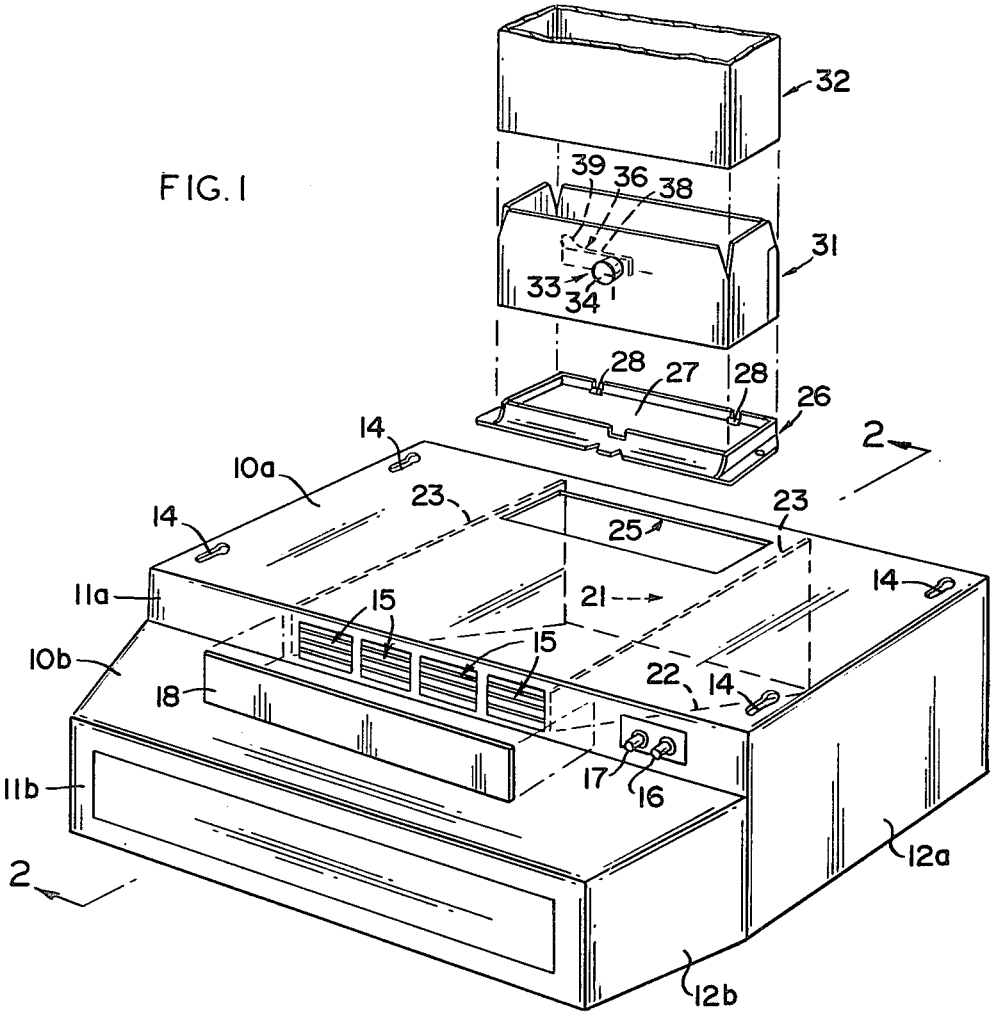
FIG. 1 is an exploded view of a range hood unit embodying the features of this invention.
Figure 2:
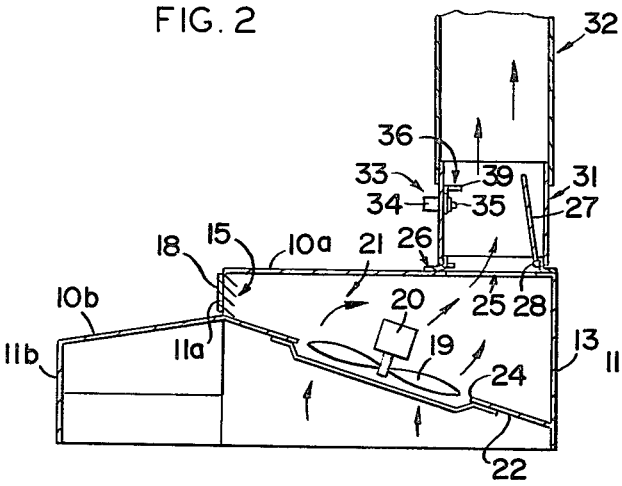
FIG. 2 is a side sectional view of the assembled range hood of FIG. 1 in its ducted operation, taken along lines 2—2 of FIG. 1, showing the location of various components including the positions of the locking cam, damper and louvers with the covering panel for said ducted operation of said range hood.
Figure 3:
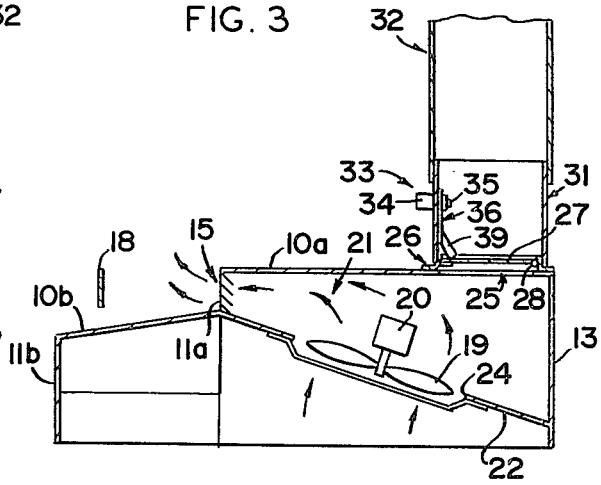
FIG. 3 is a side sectional view of the assembled range hood of FIG. 1 in its ductless operation, taken along lines 2—2 of FIG. 1, showing the locations of various components including the positions of the locking cam, damper and uncovered louvers for said ductless operation of said range hood.

This invention will be described as embodied in a range hood unit, either ducted or ductless, optionally having a filtering system, and constructed with the arrangement of the parts as illustrated in FIGS. 1–3. It is to be understood, however, that the dimensions, arrangement and assembly of the parts shown in this typical example could be changed in various ways, or the range hood could have multiple filters, and the concept of the invention would still be effective in permitting a range hood to interchangeably function in either a ducted or ductless operating mode.

Referring now to the drawings and particularly to FIGS. 1–3, the range hood is shown as comprising a generally box-like structure open at the bottom, having top panels 10*a* and 10*b*, front panels 11*a* and 11*b*, and side panels 12*a* and 12*b* (FIG. 1), and a back panel 13

(FIGS. 2 and 3). The panels on the other side of the range hood, corresponding to panels 12*a* and 12*b*, are not shown in FIG. 1. The range hood is suitably dimensioned for installation above a kitchen range and has keyhole slots 14 for mounting to an overhang, such as the bottom of a kitchen cabinet.

On front panel 11*a* are provided louvers 15, an on-off light switch 16, and a fan speed control switch 17. In the exploded view of the range hood illustrated in FIG. 1, a cover panel 18 is shown somewhat removed from a position on front panel 11*a*, where it is operable to cover louvers 15. The side of cover panel 18 which is exposed to view can appropriately have a decorative design thereon. When cover panel 18 is not being used to block the openings provided by louvers 15, it may be placed on front panel 10*b* below the louvers or in a suitable storage area. Cover panel 18 is provided with a magnetic backing for attachment to panels 10*b* or 11*a*. It is, of course, obvious that cover panel 18 can be affixed to the hood by other fastening means.

As can be seen in FIGS. 2 and 3, a fan 19 driven by an electric motor 20 is located in an inner compartment 21 within the hood below top panel 10*a*. Inner compartment 21 is bounded at the front by panel 11*a*, at the top by panel 10*a*, at the back by panel 13, at the bottom by panel 22, and at the sides by panels 23 (illustrated by broken lines in FIG. 1). A light or lights (not shown in the drawings) can conveniently be located within the hood, such as adjacent to side panel(s) 23.

Inner compartment 21 has an inlet aperture 24, which is suitably circular in shape, in its bottom panel 22. Inlet aperture 24 provides the entry point for air drawn into inner compartment 21 by fan 19, which is located so as to effectively draw air from below the hood through said inlet aperture. Fan 19 and motor 20 can be held in place in the hood by any number of conventional means, such as by a bracket support.

Two outlet apertures are provided for discharge of air from inner compartment 21, one for discharge to the exterior of the enclosure being ventilated and the other for discharge back to said enclosure. The numeral 25 in FIG. 1 indicates the outlet aperture for discharge to the exterior of the ventilated enclosure. This opening is located above inner compartment 21 in top panel 10*a*. As illustrated in FIG. 1, it is suitably located toward the rear of panel 10*a*. The other outlet aperture for returning air to the ventilated enclosure is provided by louvers 15 located in front panel 11*a*.

Mounted above hood discharge opening 25 is an adapter assembly or housing 26 to which is hingedly attached a damper 27. The adapter assembly and damper are formed of sheet metal or other suitable material. Damper 27 in the horizontal position illustrated in FIG. 1 serves to close outlet aperture 25 to the passage of air therethrough. The adapter assembly with damper is so constructed in accordance with the invention that the application of a locking means to the damper will operate to keep outlet aperture 25 closed and thus to prevent the passage of air through the aperture; and the release of the locking means will operate to permit the damper to be displaced through the force of air blown by fan 19 from the position in which it closes the outlet aperture and to thereby permit the air to pass through the outlet aperture. The damper assembly can be variously designed to accomplish this type of vent control. It should also be noted that the locking means for keeping the damper in the position closing the outlet aperture can be designed otherwise than described below and still fall within the scope of the present invention. For example, damper 27 can be locked closed by locking means applied directly or indirectly thereto. One such indirect locking means would be a blockage of the duct work between damper 27 and the exterior of the enclosure which would prevent air blown by fan 19 from moving damper 27 (described further below).

Adapter assembly 26 is a four sided mounting (FIG. 1.) which can be secured to top panel 10*a* of the hood by any convenient means. The interior space bounded by the four sides of the adapter assembly provides a channel or opening for the passage of air therethrough. As illustrated in FIG. 1, adapter assembly 26 is provided with outwardly directed flanges from its side walls for attachment to panel 10*a* by means of screws. The front side of adapter assembly 26 curves forwardly from the top with its frontmost portion designed to rest on panel 10*a* and a small projection centrally located thereon for insertion into a raised slot (not shown) on panel 10*a*.

Damper 27 is a rectangularly shaped plate (FIG. 4) and is formed of sheet metal or other suitable material. It is attached to adapter assembly 26 by means of hinges 28 provided in the back side of the adapter assembly, as shown in FIGS. 1–5. Support for damper 27 in its generally horizontal position closing outlet aperture 25 is provided by hinges 28 and by a small projection 29 attached to and extending rearwardly from the front side of adapter assembly 27 (See FIGS. 4 and 5). Projection 29 is located to the side of another projection 30 which is formed by bending down a small rectangular segment of the front side of adapter assembly 26. Projection 30 is centrally located on and also extends rearwardly from the front side of adapter assembly 26. It should be understood that other techniques can be employed in supporting damper 27 without departing from the scope of the present invention.

Projection 29 is made of a relatively soft material, such as felt or other appropriate material, which can serve as a cushion on which damper 27 will rest in its position blocking outlet aperture 25. The upper surface of projection 29 is advantageously somewhat higher than that of projection 30 so that projection 29 can serve in the manner of a bumper for preventing any bothersome noise from the damper's banging into projection 30. Damper 27 has an area smaller than that of adapter assembly 26 so that it can move freely within the interior space defined by the adapter assembly.

Transition section or duct 31 (FIG. 1) is made of sheet metal or other suitable material and is snugly mounted by any convenient means on adapter assembly 26. Duct 31 has four joined side walls and defines a generally rectangular channel extending upwardly from adapter assembly 26 to additional ducting 32, FIG. 1, which carries air discharged through outlet aperture 25 to the exterior of the household. As illustrated in FIG. 1 cutouts are made at the four top corners of transition section 31 to facilitate mounting of the above duct section 32 thereon. The ducting above transition section 31 can be used to exhaust through the roof of the enclosure or through the wall (by using a right angle elbow above the transition section). It should be understood that the damper assembly and the duct section attached to it can be of a dimension and shape other than that shown and still fall within the scope of the present invention. It is also within the scope of the invention to have the transition section and the damper assembly combined into a single unit.

A suitable locking means 33 (FIG. 1) is provided in transition section 31 for selectively locking the damper plate in the position where it closes outlet aperture 25 or unlocking the damper plate and thereby permitting it to be forced upward by air blown by fan 19. Locking means 32 is centrally mounted on the front wall of transition section 31. The locking means includes control knob 34 mounted on a relatively short shaft 35 for rotation. The end of the rotatable shaft extends through an aperture provided in the front wall of transition section 31 (see FIGS. 4 and 5). A locking cam 36 (See FIG. 9) is attached to the part of shaft 35 extending through the wall of transition section 31 for rotation thereby. Locking cam 36 consists of a plate 38 having a small projection 39. A push-on clip 37 (FIG. 5) serves to hold locking cam 36 on shaft 35 in a position such that portion 38 thereof abuts the interior side of the front wall of transition section 31 and portion 39 projects into the interior of the channel defined by the transition section.

A raised portion 40 (FIG. 10) on the front face of knob 34 serves as an indicator of the position of locking cam 36 within transition section 31. With raised portion 40 of the knob in the horizontal position shown in FIG. 10 locking cam 36 is so fastened on shaft 35 that portion 38 thereof is in a vertical position with its finger 39 projecting therefrom backward and downward into the interior space of transition section 31. In this position projection 39 of the locking cam contacts damper 27 and functions to hold it in the generally horizontal position blocking outlet aperture 25 shown in FIGS. 3, 5 and 6. Air blown by fan 19 is thereby prevented from passing through opening 25 and is instead recirculated through louvers 15 into the enclosure being ventilated, as described below.

A clockwise 90° rotation of knob 34 causes the shaft 35 and locking cam 36 to similarly rotate 90° in the clockwise direction. Such a 90° rotation brings locking cam 36 to the horizontal position shown in FIGS. 7 and 8. In this position projection 39 no longer contacts or locks down damper 27, which therefore can swing freely on hinges 28 and be displaced upward by air blown by fan 19. A dimple 41 can be provided on the back interior side of the front wall of transition section 31 to aid in maintaining locking cam 36 in the horizontal, unlocking position, as shown in FIG. 7. As illustrated in FIG. 10, the front wall of transition section 31 can be provided with markings which indicate in which position of the control knob air can be recirculated inside the ventilated enclosure—raised portion 40 of knob in horizontal position—and in which position of the knob air can be exhausted outside the ventilated enclosure—raised portion 40 of knob in vertical position.

Briefly, the operation of the venting system in accordance with the present invention can be described as follows:

When it is desired to operate the range hood of the invention as a ducted unit (exhausting air outside the enclosure) knob 34 or other control device on transition section 31 is turned to move the locking cam 36 within the transition section to the unlocking position. The position of locking cam 36 in the horizontal unlocking position, as seen from behind the front wall of transition section 31, is illustrated in FIG. 7. A side view of this portion is shown in FIG. 8. This allows the damper 27 to open and close freely. A decorative panel 18 or similar device is at the same time placed on the hood over the louvers 15 to cause the discharge of air blown by fan 19 to pass from the hood out through transition section 31 and duct to the outside of the household. When locking cam 36 is in the unlocking position and fan 19 is turned off, damper 27 will naturally rest under the influence of gravity in the position blocking opening 25. In the ducted operation of the hood, the odor filter (described below) should be removed and stored for later use in the ductless operation. Such removal helps preserve the efficiency of the filter. The passage of air in the ducted operation of the range hood of the invention is shown by the arrows in FIG. 2. The opening of the damper plate would normally be desirable, for example, in the summer season when one might want heated air from the range to be discharged to the exterior of the household.

On the other hand, in the winter season one might want to close the damper plate so as to add warmth to the household interior. In this case, the range hood is operated as a ductless unit (recirculating air inside the enclosure). This is accomplished by turning the selector knob 34 or other control device on the transition section 31 so that the locking cam 36 within the transition section locks the damper 27 shut allowing no air to pass through the duct. The position of locking cam 36 in the vertical locking position, as seen from behind the front wall of transition section 31, is illustrated in FIG. 6. A side view of this position is shown in FIG. 5. The decorative panel 18 or similar device covering the hood louvers 15 is at the same time removed to permit air blown by fan 19 to pass through the hood louvers and recirculate into the household. Additionally, an odor filter is suitably installed for the ductless operation. The passage of air in the ductless operation of the range hood of the invention is shown by arrows in FIG. 3.

Figure 11:
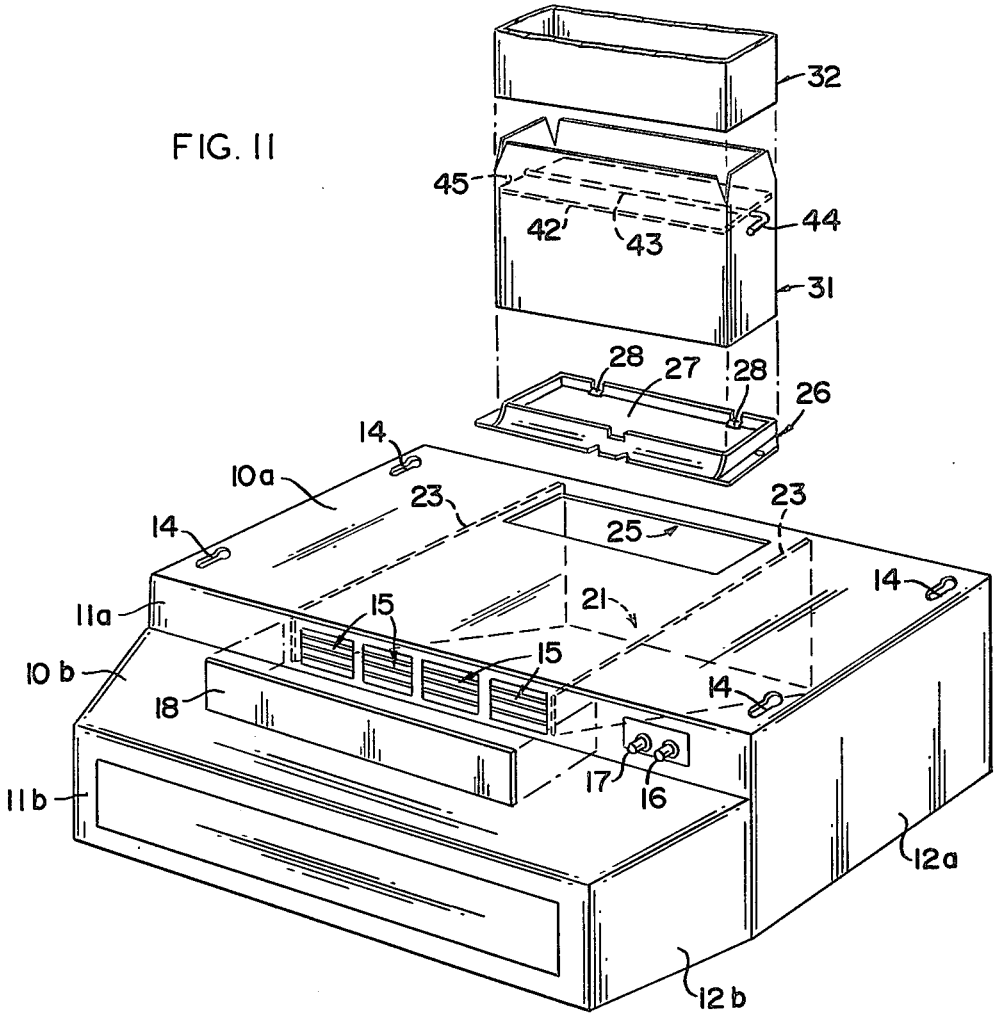
FIG. 11 is an exploded view of another embodiment of the range hood of the present invention.
Figure 12:
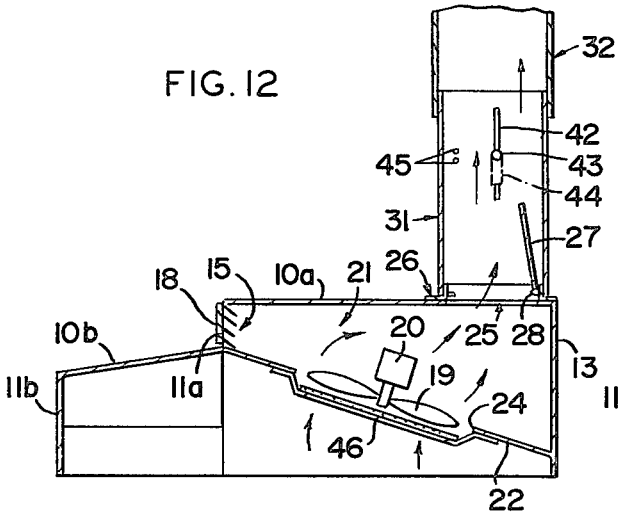
FIG. 12 is a side sectional view of the assembled range hood of FIG. 11 in its ducted operation, showing the positions of the dampers and louvers with covering panel and the passage of air in said ducted operation of the hood.
Figure 13:
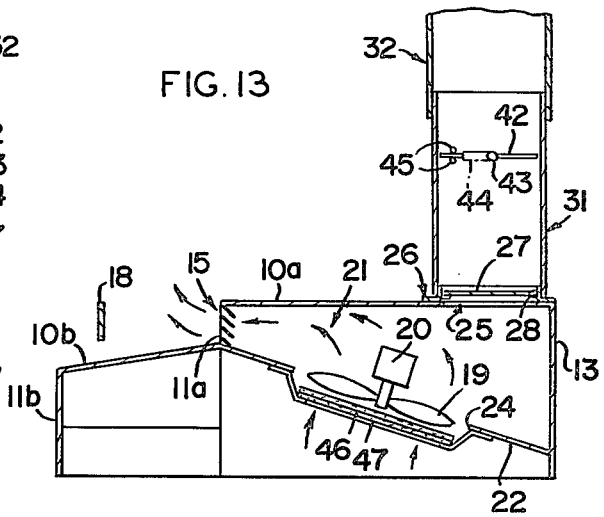
FIG. 13 is a side sectional view of the assembled range hood of FIG. 11 in its ductless operation, showing the positions of the dampers and uncovered louvers and the passage of air in said ductless operation of the hood.

Another advantageous embodiment of the range hood of the present invention is illustrated in FIGS. 11–13. The range hood in this embodiment is similar in shape and design to the range hood of FIG. 1 previously discussed. It differs only in the locking and unlocking mechanism used to control damper 27. All other components of the range hood shown in FIGS. 11–13 are the same as in the range hood of FIGS. 1–10.

The locking and unlocking means for the range hood illustrated in FIG. 11 comprises a manually operable closure member or control damper 42. Damper 42 is a plate of sheet metal or other suitable material mounted in duct or transition section 31. The plate is rectangular in shape and has an area just slightly smaller than that of the rectangular opening provided in transition section 31 for air passage therethrough. The plate is received in duct section 31 as shown in FIGS. 11–13. Felt strips can suitably be located at its edges to prevent metal-to-metal contact between the interior surface of the transition section and damper 42 when the latter is in the horizontal position closing off the air passage through the duct.

Damper plate 42 is attached by any convenient means to a rod 43 (FIG. 11) extending along the center thereof from one side wall of transition section 31 to the other. As illustrated in FIG. 11, one end of the rod is secured for rotation to one side wall of the transition section 31 and the other end extends through an aperture located in the other side wall of the transition section. The latter end is bent to provide a control handle 44 which extends along the exterior surface of the side wall.

The damper plate 42 is fixed or secured on a rode 43 and rotatable as an assembly therewith. Two dimples 45 are provided, one above the other, in the surface of the side wall of the transition section for holding handle 44 in the horizontal position (See FIGS. 12 and 13).

The ducted and ductless mode of operation of the range hood of FIG. 11 are illustrated in FIGS. 12 and 13, respectively. When it is desired to operate the range hood as ducted unit, cover panel 18 is installed over the louvers and control rod handle 44 is set in the vertical position shown in FIG. 12. Setting handle 44 in this position correspondingly sets damper 43 in the vertical position whereby it is in an unblocking relation with respect to the transition section. With this arrangement of cover panel 18 and damper 2, air blown by fan 19 forces damper 27 open and thereby passes to the exterior of the household, as illustrated by the arrows in FIG. 12.

In the ductless mode of operation of the above embodiment of the range hood of the invention, cover panel 18 is removed from louvers and handle 44 is turned to the position between dimples 45. Damper 42 is thereby secured in the horizontal position illustrated in FIG. 13 with the result that it blocks off or closes the transition section to the passage of air. Thus air blown by fan 19 cannot lift damper 27 from its position closing outlet aperture 25 and must instead pass through louvers 15 to the interior of the household.

Filtering means for use in the range hood of the invention are also illustrated in FIGS. 12 and 13. Although a ducted range hood could be operated without a filter, since the heated air, steam and other volatiles are discharged outside the building, such operation is unsatisfactory because grease and food particles tend to collect on the fan blades and in the discharge duct which then becomes unsanitary and also involves a fire hazard. The ducted hood therefore requires a grease filter for satisfactory, safe operation. The grease filter is an open-mesh, framed panel, installed within the range hood below the blower, as, e.g., in the position of unit 46 of FIG. 12. In this way all the heated air drawn into the hood by the fan first passes through the filter which collects virtually all of the grease and other food particles or spatter carried in the air stream. The grease filter is usually constructed from a non-corrodible metal, such as aluminum, usually in the form of coarse expanded mesh made from thin sheet aluminum. This expanded mesh is of open structure so as not to restrict appreciably the air flow induced by the fan.

Also, it is preferably coated or chemically treated so as to increase its ability to adhere to and retain grease and other food particles in the air stream and to improve ease of cleaning the filter. An especially effective coating material for an aluminum mesh grease filter is "Teflon-S" (a polyfluorocarbon product of the DuPont Company), but various other synthetic grease-resistant coating materials may be used. Polymerized fluorocarbons, such as polytetrafluoroethylene and fluorinated ethylene-propylene, are the preferred coating compositions, due to their chemical inertness, resiliency, resistance to moisture and steam, wide range of service temperatures, heat resistance up to 500° F. without carbonization, and resistance to embrittlement.

Because substantial quantities of grease accumulate in the filter interstices from continued use of the range hood, the framed filter panel is installed so as to be easily removable for cleaning. The grease accumulation is easily removed by light agitation of the filter mesh with a detergent solution and the filter panel, after drying, may be re-installed in the hood for another period of service.

A grease filter of the same kind as used in the ducted operation is also advantageous in the ductless operation of the range hood. Additionally, in the ductless mode of operation there is usually provided a granulated, activated charcoal filter to absorb cooking odors. An additional odor filter 47 is included in the filter arrangement shown in FIG. 13. In the ductless operation the range hood may also have a filter of spun glass fiber that may be chemically treated or coated to enable it to absorb smoke particles and also any fine grease particles that may not have been trapped by the aluminum mesh grease filter. The activated charcoal filter and the glass fiber filter are inexpensive and are intended to be replaced after a period of use, before they become clogged and ineffective.

It is obvious that the concept of this invention is adaptable to prefabricated domestic range hood units of varying sizes and shapes, to provide them with a unique mechanism for controlling the direction of air discharge within the hood whereby it can be operated as either a ducted or ductless unit. The concept can, for example, be readily applied to the range hood unit described in U.S. Pat. No. 3,690,245. The invention therefore resides not only in the above-described range hood, but also in a method of venting air from an enclosure whereby the air is blown to the interior or exterior of the enclosure utilizing control means which either confine the air flow to a given path or permit it to force open an alternate path.

Included within the scope of the present invention is a ductless/ducted hood conversion kit. The purpose of this energy saving kit is to permit conversion of a given existing range hood of appropriate design into one which is capable of either a ducted or ductless mode of operation. The kit comprises a cover panel 18, adapter assembly with damper 26 and damper control transition section 31, as illustrated in FIG. 1 of the drawings. The kit can be conveniently installed, for example, over a standard top, $3\frac{1}{4}'' \times 10''$ range hood knockout. It may be used to exhaust through the roof or through the wall (by using a right angle stack elbow) by connecting the appropriate ducting above the damper control transition section.

Whereas the present invention has been described with respect to specific embodiments thereof, it should be understood that the invention is not limited thereto as many modifications thereof may be made. It is therefore contemplated to cover by the present application any and all such modifications as fall within the true spirit and scope of the appended claims.

We claim:

1. A range hood for an enclosure comprising:

(a) a hood including an inner compartment, said compartment having an air inlet aperture and first and second air outlet apertures;

(b) a blower means disposed within said hood and adapted to draw air from said enclosure through said air inlet aperture into said inner compartment and to discharge the air from said inner compartment through said outlet apertures;

(c) a damper member mounted for movement between a first position blocking said first outlet aperture and a second position not blocking said first outlet aperture, said damper member being normally biased to said first, blocking position;

(d) a means for selectively locking or unlocking said damper member in said first position; and (e) a means independent of said damper member for selectively opening or closing said second outlet aperture, such that, when said second outlet aperture is open and said damper member is locked in said first position, the air drawn into said inner compartment by said blower means is discharged therefrom through said second outlet aperture and, when said second outlet aperture is closed and said damper member is not locked in said first position, the air drawn into said inner compartment by said blower means moves said damper member to said second position and is discharged out of said first outlet aperture.

2. The range hood of claim 1 wherein the means for locking or unlocking the damper member comprises:

(a) a locking cam mounted for movement on a shaft adjacent said damper member; and (b) a means for turning said shaft to thereby move said locking cam to (i) a first position where it holds said damper member in the position blocking the first outlet aperture and (ii) a second position where it does not hold said damper member in said blocking position.

3. The range hood of claim 2 wherein the damper member is hingedly mounted for movement between the first position blocking the first outlet aperture and the second position not blocking said first outlet aperture.

4. The range hood of claim 2 wherein the means for locking or unlocking the damper member is located on a duct which is mounted on said range hood and provides a channel for air discharged from the inner compartment of said range hood through the first outlet aperture.

5. The range hood of claim 4 wherein the duct is mounted on said range hood by means of a four-sided mounting which includes hinge means for the damper member.

6. The range hood of claim 5 wherein said mounting further includes means to support said damper member in the first, blocking position.

7. The range hood of claim 6 wherein said support means comprises at least one projection from said mounting.

8. The range hood of claim 7 wherein said support means comprises a felt and a metal projection, said felt projection being positioned to serve as a cushion between the damper member and said metal projection.

9. The range hood of claim 1 wherein the means for opening or closing the second outlet aperture comprises a cover panel for placing over said outlet aperture to close it and for removing therefrom to open it.

10. The range hood of claim 9 wherein the cover panel has a magnetic backing for attachment to said range hood.

11. The range hood of claim 9 wherein the second outlet aperture comprises louvers.

12. The range hood of claim 1 wherein the means for locking or unlocking the damper member comprises:

(a) a duct mounted on said range hood which provides a channel for air discharged from the inner compartment of said range hood through the first outlet aperture, (b) a control damper mounted in said duct for movement therein between (i) a first position blocking and (ii) a second position not blocking said duct to the passage of air therethrough, and (c) a means for moving said control damper between said first and second positions, with the proviso that said control damper is positioned in said duct so that it does not contact said damper member of claim 1 in the operation of said range hood.

13. The range hood of claim 12 wherein the control damper is fixed to a rod which is mounted for rotation in the duct and the means for moving said control damper comprises an end of said rod extending through an aperture in said duct to the exterior thereof.

14. A range hood for drawing air from an enclosure and selectively discharging the air to the exterior or interior of the enclosure comprising:

(a) a hood including an inner compartment, said compartment having (i) an air inlet aperture, (ii) a louvered opening to the interior of the enclosure and (iii) an opening to the exterior of the enclosure;

(b) a blower means disposed within said hood and adapted to draw air from said enclosure through said air inlet aperture into said inner compartment and to discharge the air from said inner compartment through said openings to the interior and exterior of said enclosure;

(c) a duct mounted adjacent said opening to the exterior of the enclosure and providing a channel for air discharged from said inner compartment;

(d) a damper hingedly mounted over said opening to the exterior of the enclosure for movement between a first position blocking said opening and a second position not blocking said opening, said damper being normally biased to said first, blocking position;

(e) a panel for covering said louvered opening; and (f) a locking cam mounted on said duct for rotation between a first position wherein said locking cam holds said damper in the position blocking said opening to the exterior of the enclosure and a second position wherein said locking cam does not hold said damper in said blocking position;

such that, when said louvered opening is not covered by said panel and said damper is held in the first position blocking said opening to the exterior of the enclosure, the air drawn into said inner compartment by said blower means is discharged therefrom through said louvered opening to the interior of the enclosure and, when said louvered opening is covered by said panel and said damper is not held in said first position, the air drawn into said inner compartment by said blower means moves said damper to the second position not blocking said opening to the exterior of the enclosure and the air is discharged to the exterior of the enclosure.

15. The range hood of claim 14 wherein the duct mounted adjacent the opening to the exterior of the enclosure and the damper hingedly mounted over said opening are both affixed to a four-sided mounting attached to said range hood.

16. The range hood of claim 15 wherein said four-sided mounting includes means for supporting the damper in the first, blocking position comprising a felt and a metal projection, said felt projection being positioned to serve as a cushion between said damper and said metal projection.

17. A range hood for drawing air from an enclosure and selectively discharging the air to the exterior or interior of the enclosure comprising:

(a) a hood including an inner compartment, said compartment having (i) an air inlet aperture, (ii) a louvered opening to the interior of the enclosure and (iii) an opening to the exterior of the enclosure;

(b) a blower means disposed within said hood and adapted to draw air from said enclosure through said air inlet aperture into said inner compartment and to discharge the air from said inner compartment through said openings to the interior and exterior of said enclosure;

(c) a duct mounted adjacent said opening to the exterior of the enclosure and providing a channel for air discharged from said inner compartment;

(d) a first damper hingedly mounted over said opening to the exterior of the enclosure for movement between a first position blocking said opening and a second position not blocking said opening, said first damper being normally biased to said first, blocking position;

(e) a second damper fixed to a rod and rotatably mounted in said duct for movement between (i) a first position blocking and (ii) a second position not blocking said duct to the passage of air therethrough, said rod extending through an aperture in said duct to the exterior thereof, with the proviso that said second damper is positioned in said duct so that it does not contact said first damper in the operation of said range hood; and (f) a panel for covering said louvered opening;

such that when said louvered opening is not covered by said panel and said second damper is set in said first position blocking said duct to the passage of air therethrough, said first damper rests in the position blocking said opening to the exterior of the enclosure and the air drawn into said inner compartment by said blower means is discharged therefrom through said louvered opening to the interior of the enclosure, and, when said louvered opening is covered by said panel and said second damper is set in said second position not blocking said duct to the passage of air therethrough, the air drawn into said inner compartment by said blower means moves said first damper to the position not blocking said opening to the exterior of the enclosure and the air is discharged to the exterior of the enclosure.

18. The range hood of claim 17 wherein the duct mounted adjacent the opening to the exterior of the enclosure and the first damper hingedly mounted over said opening are both affixed to a four-sided mounting attached to said range hood.

19. The range hood of claim 18 wherein said four-sided mounting includes means for supporting the first damper in the blocking position, comprising a felt and a metal projection, said felt projection being positioned to serve as a cushion between said first damper and said metal projection.

20. A conversion kit for installation in a range hood to enable said range hood to selectively exhaust air outside a ventilated enclosure or recirculate air inside said ventilated enclosure comprising:

(a) a four-sided mounting for attachment to said range hood adjacent an opening in said hood to the exterior of said enclosure;

(b) a damper hingedly affixed to and supported by said mounting for movement between a first position blocking said opening and a second position not blocking said opening, said damper being normally biased to said first blocking position;

(c) a duct for mounting on said four-sided mounting to provide a channel to the exterior of said enclosure;

(d) a means attached to said duct for selectively locking or unlocking said damper in said first, blocking position; and (e) a cover panel.

21. The kit of claim 20 wherein said means for selectively locking or unlocking said damper comprises a locking cam rotatably mounted on a shaft.

22. The kit of claim 20 wherein said means for selectively locking or unlocking said damper comprises a second damper fixed to a rod and rotatably mounted in said duct for movement between (i) a first position blocking and (ii) a second position not blocking said duct to the passage of air therethrough.

* * * * *